US012004579B2

(12) United States Patent
Sarcone Martin et al.

(10) Patent No.: US 12,004,579 B2
(45) Date of Patent: Jun. 11, 2024

(54) CAMOUFLAGE SYSTEMS AND METHODS OF MAKING CAMOUFLAGE SYSTEMS

(71) Applicant: INVISIBLE ORANGE, LLC, Sallisaw, OK (US)

(72) Inventors: Jeffrey David Sarcone Martin, Sallisaw, OK (US); James Stephen Schilling, Fort Smith, AR (US)

(73) Assignee: Invisible Orange, LLC, Sallisaw, OK (US)

( * ) Notice: Subject to any disclaimer, the term of this patent is extended or adjusted under 35 U.S.C. 154(b) by 176 days.

(21) Appl. No.: 16/163,485

(22) Filed: Oct. 17, 2018

(65) Prior Publication Data

US 2019/0110540 A1 Apr. 18, 2019

Related U.S. Application Data

(60) Provisional application No. 62/573,678, filed on Oct. 17, 2017.

(51) Int. Cl.

| | |
|---|---|
| ***F41H 3/00*** | (2006.01) |
| ***A41D 13/00*** | (2006.01) |
| ***A41D 31/02*** | (2019.01) |
| ***A41D 31/04*** | (2019.01) |
| ***F41H 3/02*** | (2006.01) |

(Continued)

(52) U.S. Cl.

CPC ..... *A41D 31/02* (2013.01); *A41D 13/00* (2013.01); *A41D 31/04* (2019.02); *F41H 3/00* (2013.01); *F41H 3/02* (2013.01); *A41D 1/08* (2013.01); *A41D 3/02* (2013.01); *A41D 19/0051* (2013.01); *A41D 2600/108* (2013.01);

(Continued)

(58) Field of Classification Search

None

See application file for complete search history.

(56) References Cited

U.S. PATENT DOCUMENTS 6,625,816 B1 * 9/2003 Cooke ..... A41D 19/0062 2/161.5

7,775,919 B2 8/2010 Oswald (Continued)

FOREIGN PATENT DOCUMENTS

WO 2009054872 4/2009

OTHER PUBLICATIONS

Chinese Office Action for Chinese Application No. 201880081643X dated Jan. 5, 2022.

*Primary Examiner* — Laura C Powers

(74) *Attorney, Agent, or Firm* — Ferguson Case Orr Paterson

(57) ABSTRACT

A camouflage system and methods of making camouflage systems. The camouflage comprises a series of image layers that are sequenced and superimposed to create a repeatable composite image that reduces visibility to first set of sensors (e.g., an animal's eyes) while enhancing visibility to a second set of sensors (e.g., a human's eyes). The camouflage includes a base set of layers that may be used to mimic a macro-environment, a pattern layer, and a detail set of layers that may be used to mimic a microenvironment. The camouflage may be presented in various color schemes, with one suitable scheme being a range of colors centered around safety orange (Pantone 152) and a range of colors from grey to black.

15 Claims, 14 Drawing Sheets
(14 of 14 Drawing Sheet(s) Filed in Color)

(51) Int. Cl.

| | |
|---|---|
| *A41D 1/08* | (2018.01) |
| *A41D 3/02* | (2006.01) |
| *A41D 19/00* | (2006.01) |
| *A42B 1/004* | (2021.01) |
| *A43B 3/00* | (2022.01) |

(52) U.S. Cl.
CPC ..... *A42B 1/004* (2013.01); *A43B 3/0036* (2013.01); *Y10T 428/24802* (2015.01)

(56) References Cited

U.S. PATENT DOCUMENTS

| | | | | |
|---|---|---|---|---|
| 8,507,077 | B1 * | 8/2013 | Bentley | B41M 3/008 428/195.1 |
| 2002/0110652 | A1 * | 8/2002 | Conk | B44F 9/00 428/15 |
| 2009/0154777 | A1 * | 6/2009 | Cincotti | F41H 3/00 382/111 |
| 2011/0008591 | A1 * | 1/2011 | Bernegger | D06P 7/00 428/196 |
| 2014/0212638 | A1 | 7/2014 | McPherson | |
| 2015/0230525 | A1 * | 8/2015 | DeMille | F41H 3/02 2/69 |
| 2016/0178324 | A1 * | 6/2016 | Wiley, III | F41H 3/02 428/196 |

* cited by examiner

CAMOUFLAGE SYSTEMS AND METHODS OF MAKING CAMOUFLAGE SYSTEMS

RELATED APPLICATION

This application claims the benefit of Provisional application No. 62/573,678, filed Oct. 17, 2017.

BACKGROUND OF THE DISCLOSURE

Field of the Disclosure

The invention relates to camouflage systems and, more particularly, to systems that utilize various features to reduce visibility to a first set of sensors while increasing visibility to a second set of sensors.

Description of the Related Art

Current camouflage (or "camo") configurations and methods are used to make a person or objects difficult or impossible to see against background or environment. The primary objective of camo is for concealment. It is used in both military/defense applications and civilian/sporting applications.

Current camo technologies employ artificial illustrations and/or artist renderings of environments and patterns. Often these renderings are two-dimensional and linear in terms of depth of field.

In sporting and hunting applications, camouflage is often limited by safety rules that reduce effectiveness (i.e., invisibility), for safe and ethical hunting practices. For example, the International Hunter Education Association ("IHEA") recommends that a bright shade of orange (often referred to as "hunter orange," "safety orange," or "blaze orange"; identified as Pantone 152) is the most effective color to be worn by hunters in the field, to prevent hunting accidents. Forty-three (43) out of fifty (50) states require hunters to wear blaze orange during specified hunting seasons. In 2010, the Oregon Department of Fish and Wildlife reported that 81 percent of victims in vision-related hunting incidents were not wearing blaze orange clothing.

Before camouflage became widely available for military use and warfare, it was already widely utilized in early human civilization. Camouflage has been around since humans began hunting and gathering. It has been suggested that early human civilization from the Lower Paleolithic hunter-gatherer society habitated areas of dense forests and woodlands. Using vegetation, earth, and surrounding foliage for concealment as part of their garments, they utilized the earliest form of camouflage for hunting in wooded areas and forest covers. However, preceding human usage, the earliest forms of camouflage were the product of evolution and are readily observed in nature. There are many forms of camouflage found in nature. Some of these natural camo concepts include, for example: "crypsis" or visual concealment; "mimicry" or resemblance adaptation; "disruptive coloration" or pattern paradox; "aposematism" or antipredator adaptations; and counter-shading, sometimes referred to as "Thayer's Law".

There is a need in the industry for a camouflage system that incorporates some of these evolutionary concepts into a new application that renders a hunter invisible to prey for effectiveness while remaining visible to other hunters for safety.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE DISCLOSURE

Figure 1:
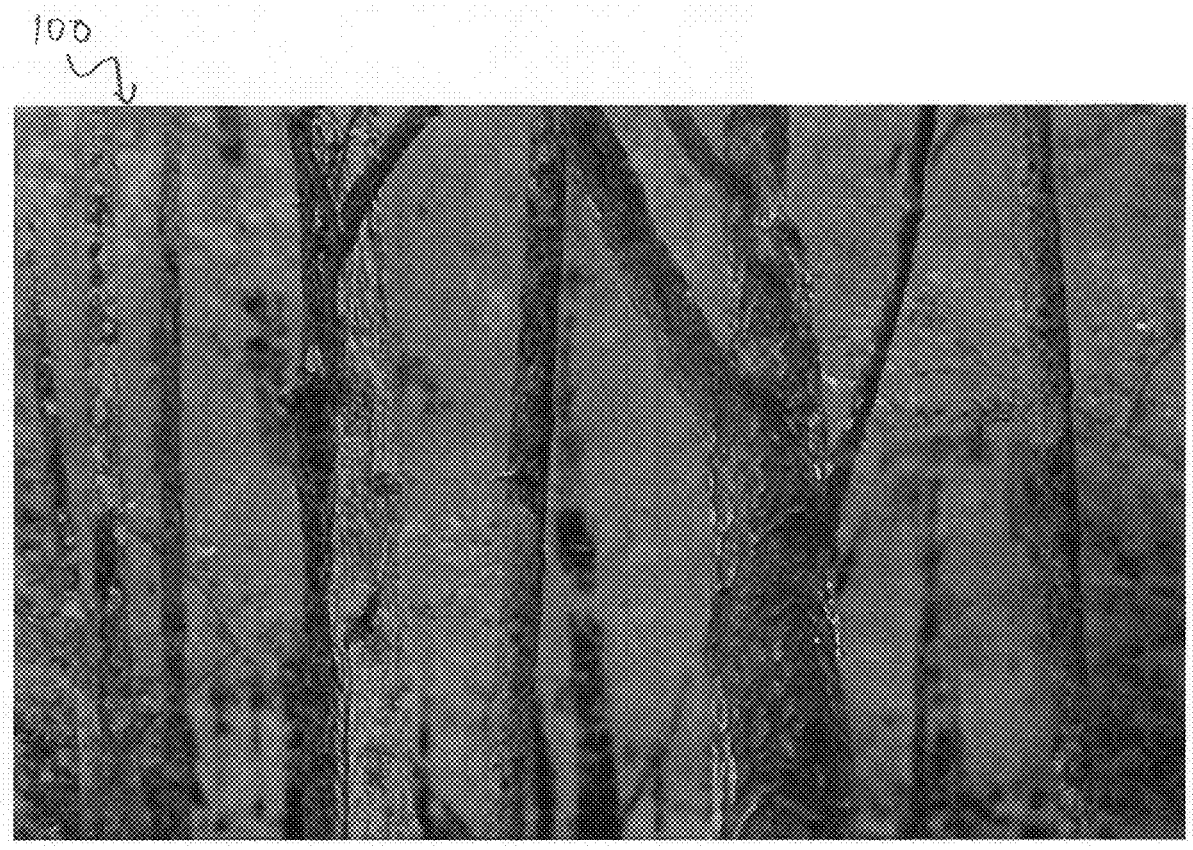
FIG. 1 is an image of a camouflage system according to an embodiment of the disclosure.

Embodiments of a camo system/method are described herein with reference to certain embodiments, but it is understood that the system/method can be embodied in many different forms and should not be construed as limited to the embodiments set forth herein. In particular, the present invention is described below in regards to certain camo systems and methods of creating those systems, but it is understood that elements of the embodiments described can be used in other systems. The systems can also be used in many different environments and settings.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the system in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

Embodiments of the invention are described herein with reference to exemplary illustrations. As such, the actual dimensions of elements can be different, and variations from the shapes of the illustrations as a result, for example, of manufacturing techniques and/or tolerances are expected. Thus, the elements illustrated in the figures are exemplary in nature and their shapes are not intended to illustrate the precise shape of an image or a pattern and are not intended to limit the scope of the invention.

The camouflage systems described herein are designed to render an object (e.g., a person, a vehicle, a structure, etc.) invisible to a first class of sensors while allowing the object to remain visible to a second class of sensors. In one exemplary embodiment, the camouflage system may be incorporated into clothing and/or accessories designed to be worn by hunters. The camouflage renders the hunter substantially invisible to the animal while allowing the hunter to remain visible to other hunters, in fact, improving visibility to other hunters in many cases. Although many other applications are contemplated by the disclosure, reference will be made to this exemplary embodiment throughout.

One embodiment of the present disclosure is directed to both a camouflage product having overlaid images that give the camouflage a three-dimensional look and a process for making that product. The invention improves camouflage both aesthetically and functionally. The camouflage uses a combination of high and low definition environment images. These images are overlaid on the item to be camouflaged, which provides a three-dimensional look with two-dimensional images. A geometric pattern is also overlaid onto the image to assist in concealment. In some embodiments, the images are colored using a range of orange hues that is nearly undetectable by deer but easy for spotting by other hunters, for example a range of orange colors clustered around Pantone 152. In other embodiments, the original color of the images taken directly from the hunting environment aids in concealment. Other optional features include having two different camouflage patterns on a garment or product such that it is reversible and thus suitable for different hunting purposes.

In one embodiment of the camouflage system, safety orange is the primary color that is used. The camo system disclosed herein functions both as safety equipment and also sporting equipment. In nature, animals use aposematism or antipredator adaptations and warning coloration as cautioning signals. The present system, though not used for antipredator purposes, provides visual warning to other hunters.

Another aspect of the camo system is the use of a color group that is indiscernible to variety of game species. This advantage is obtained due to the inability of some species of animals to see in trichromatic colors. Humans are trichromats, being able to see all the visual spectrum of color, corresponding to a wavelength range of 400-700 nanometers (nm) and a color range of violet through red. Almost all known placental mammals and upland birds have dichromatic vision. Dichromacy is the state of having two types of functioning color receptors, called cone cells, in the eyes. Organisms with dichromacy, i.e., dichromats, can match any color they see with a mixture of no more than two pure spectral lights. Dichromats cannot perceive color in the range of 620 nm-700 nm. This is useful in hunting applications, especially because safety orange is within this range.

Although systems and methods disclosed herein are not to be bound by any scientific theory, it is understood that several camouflage concepts may contribute to the effectiveness of these systems and methods. The present camo system blends several different forms of camouflage: crypsis, aposematism, mimicry, disruptive coloration and Thayer's law (counter-shading).

In another aspect, the present camo system incorporates images to create a scene that appears three-dimensional, using two dimensional images. The appearance of three-dimensionality is accomplished by layering and organizing multiple layers of images and structures to achieve level of depth of field. It is understood that the term "three-dimensional" is used throughout the disclosure to mean that a given scene or pattern appears three-dimensional, which will be obvious to a person of skill in the art that understands that all images and scenes are actually two-dimensional.

In another aspect of the disclosure, images used in the camo system are produced from high resolution photographs from known environments that a particular species or group of species inhabits or from an area where a particular user desires to hunt. Additionally, these high definition images in the camouflage can mimic natural habitat but do not necessarily have to do so.

In another aspect of the disclosure, several non-repeating layers of foliage and environment may be incorporated into a seamless and more realistic composite image. The layers may be created using multiple photographs and interleaved and/or superimposed using a software program to stitch the images together.

In another aspect of the disclosure, the images of the camo system break up anatomical silhouettes of unnatural habitat by using repeating octagonal or hexagonal shapes, canvasing the camouflage. This is designed to utilize the effects of visual crypsis, which breaks up visual outlines of the user or object on which the camo is used.

In another aspect of the disclosure, two main colors may be used: Pantone 152 or blaze orange and black. This color combination is suitable for the camo system as it incorporates a spectrum that is invisible to many species of game while adhering to safety laws and enabling the hunter to be seen by other hunters. Contrast and tonal adjustments may be made to base color Pantone 152 to provide a variety of shades of the base blaze orange color. It is understood that many other color systems can be used to achieve effective camouflage for hunting various species that see a particular color less easily.

In another aspect of the disclosure, the system uses images of organic material as opposed to artificial reproductions. Known camouflage systems utilize artist-or computer-generated images that are synthetic. These images are often stitched together to create a continuous repeating environment. Embodiments of the camo system use images of real-world environment and surroundings. Various embodiments of the camo system will utilize images that are native to a particular geographical area.

In another aspect of the disclosure, images will be used that simulate the natural environment. The system avoids unnecessary repetition of the same image. Embodiments of the camo system use continuous imagery of scenes where a particular game species resides. In some embodiments, multiple photographs are merged together to simulate real-world scenery.

FIG. 1 shows a camo system 100 according to one embodiment of the present disclosure. In this particular embodiment, the camo system 100 comprises a series of seven layers to create the camo design that includes base colors safety orange (Pantone 152) and black, and a plurality of shades, saturations, and contrasts close to those base colors. For ease of reference, these layers are shown sequentially in subsequent figures. It is understood that more or fewer layers may be used to achieve a similar effect.

Figure 2:
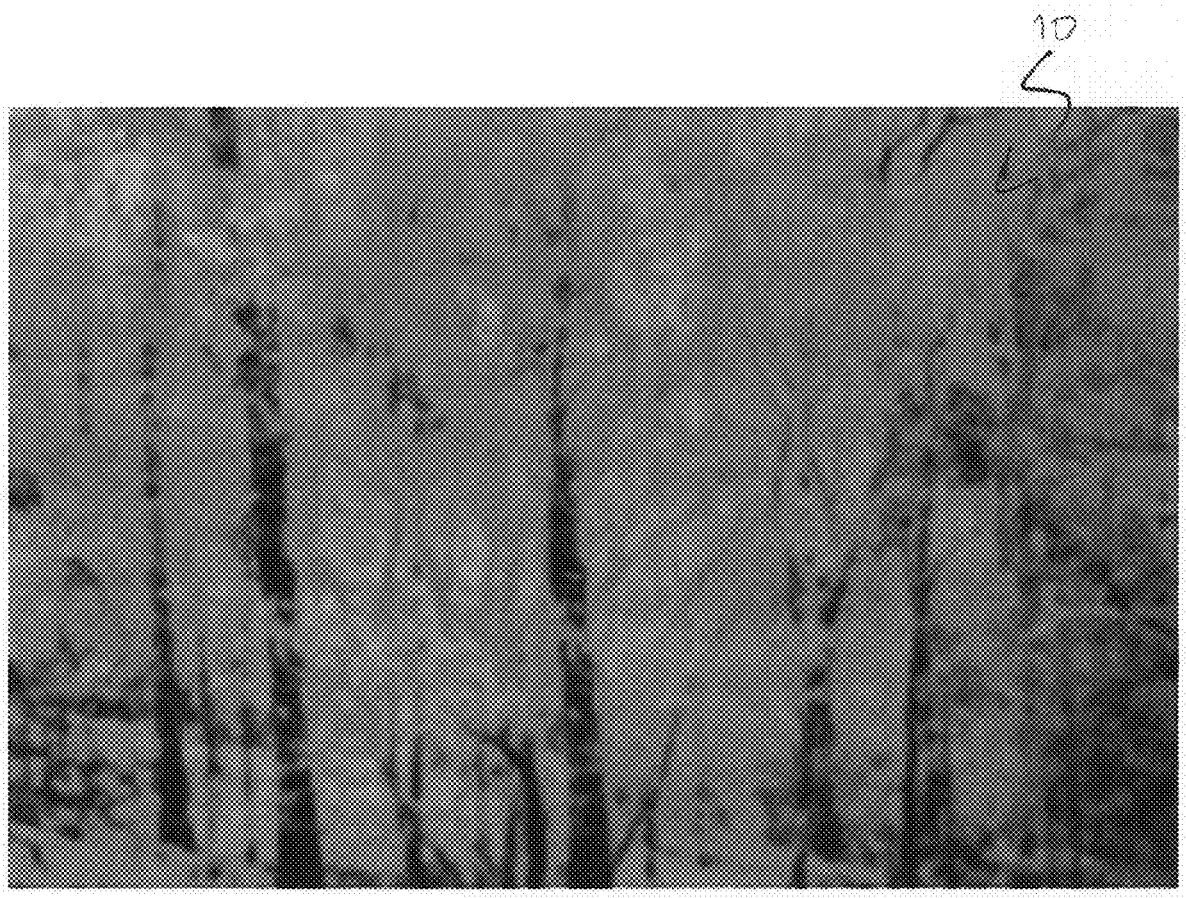
FIG. 2 is an image of a layer of a camouflage system according to an embodiment of the disclosure.

FIG. 2 shows a first image layer 10 for use in embodiments of the present disclosure. In this particular embodiment, a first layer 10 uses photographs of an unfocused background, taken using a high definition DSLR camera, for example. The unfocused background functions as a backdrop for the environment, e.g., a wooded area. This is an example of disruptive coloration: a form of camouflage that uses a highly contrasting pattern, which disrupts the outline and contour of an object or person.

Figure 3:
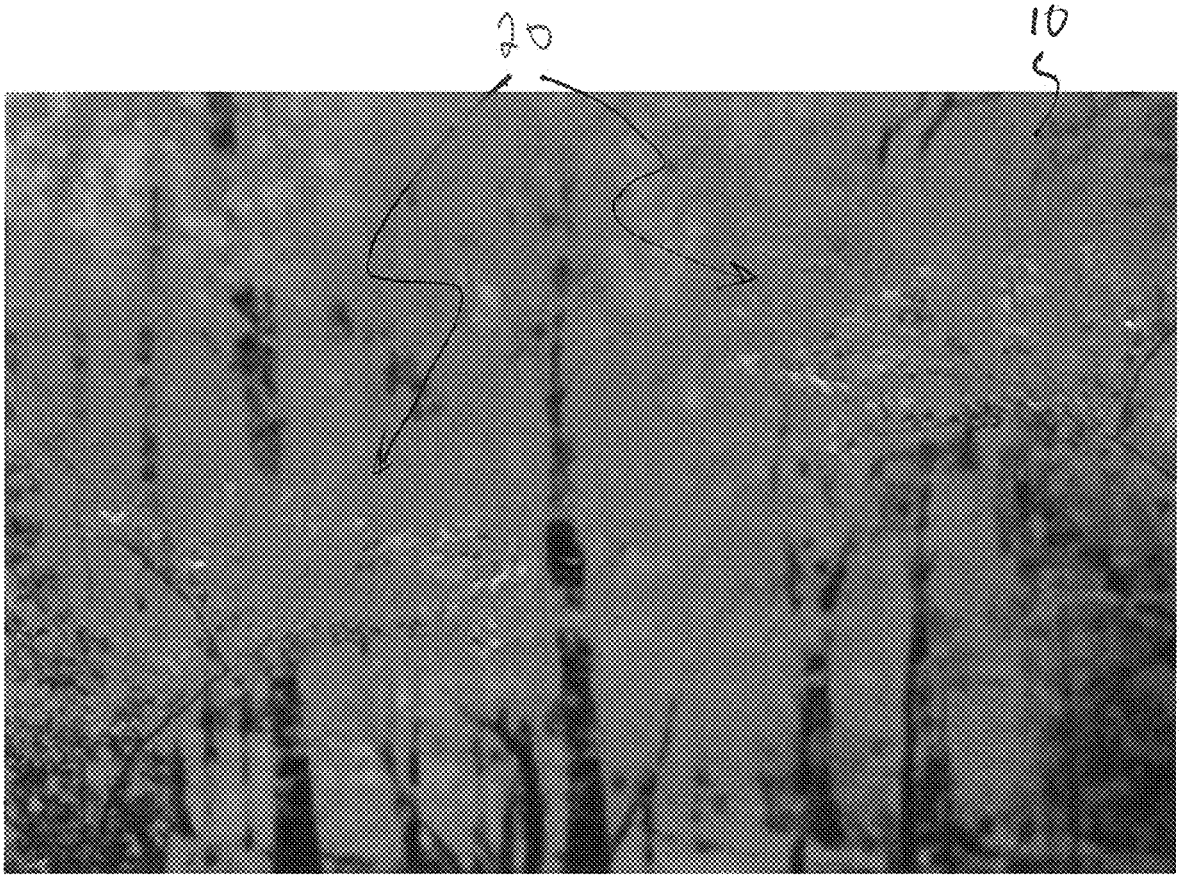
FIG. 3 is an image of multiple layers of a camouflage system according to an embodiment of the disclosure.

FIG. 3 shows a composite image of layers 10, 20 for use in embodiments of the present disclosure. The second layer 20 comprises an image of semi-focused foliage or other natural imagery. This layer is used to increase the depth of field.

Figure 4:
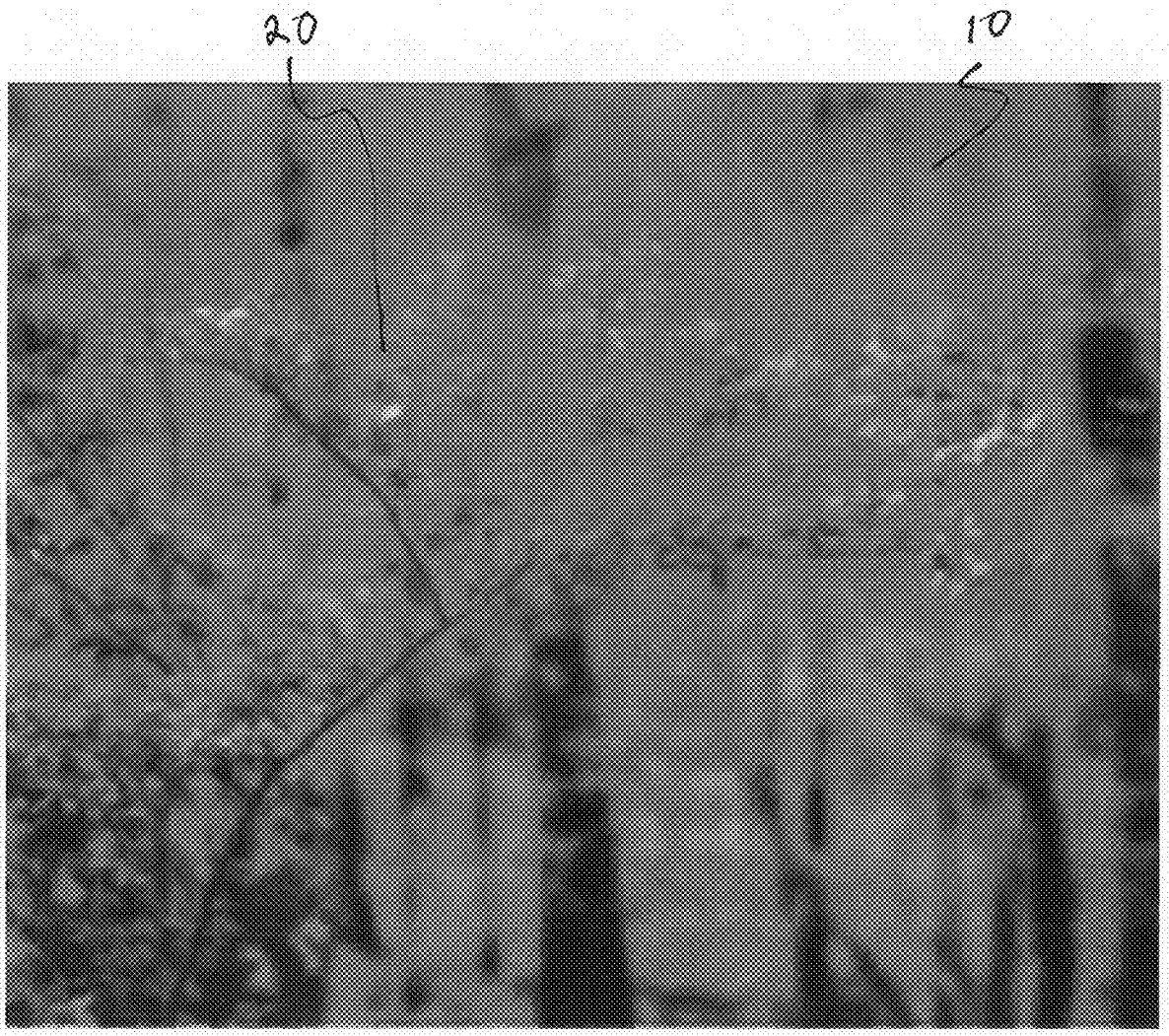
FIG. 4 is a close-up of a portion of the image of FIG. 3.

FIG. 4 shows a close-up of a portion of the composite image of FIG. 3.

Figure 5:
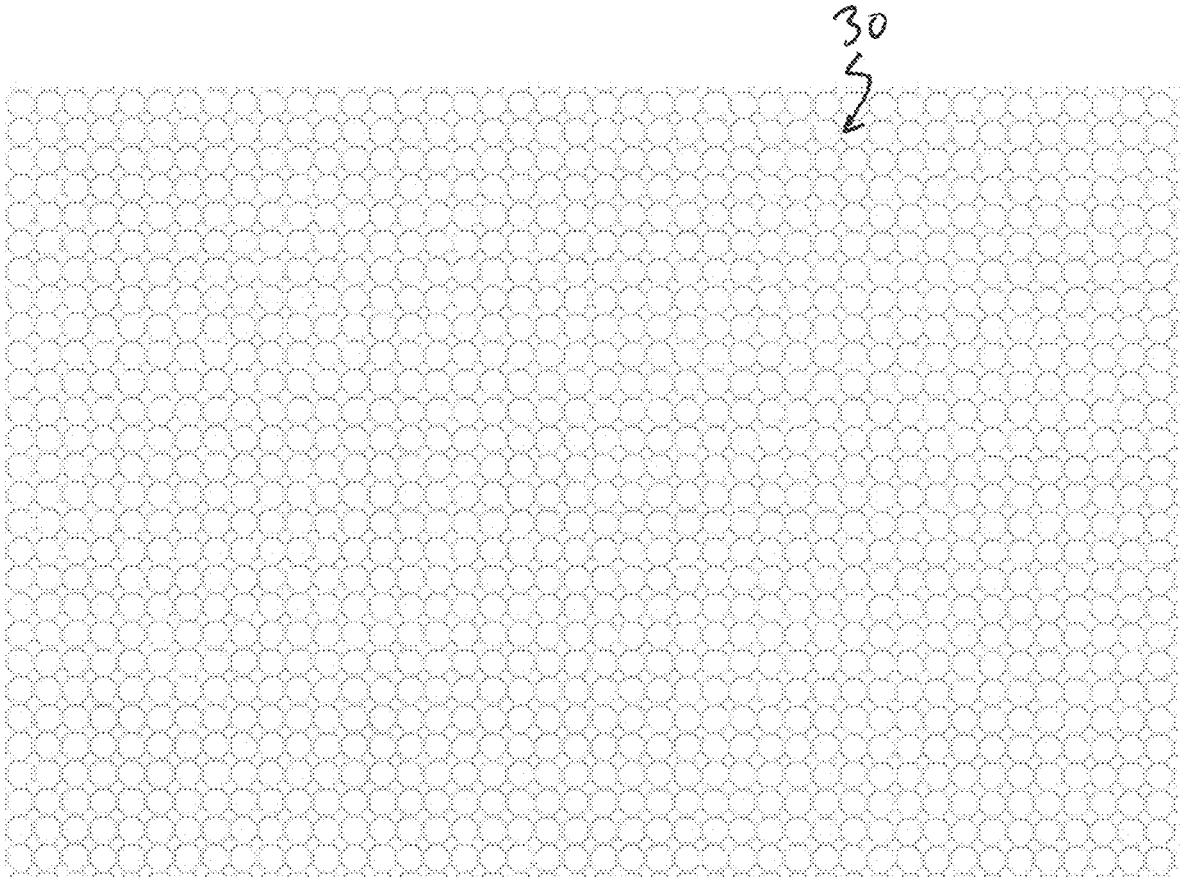
FIG. 5 is an image of a layer of a camouflage system according to an embodiment of the disclosure.

FIG. 5 shows a third image layer 30 for use in embodiments of the present disclosure. The third layer 30 may be a pattern layer that utilizes visual crypsis to fragment the visual outline of an object or person. The pattern layer 30 may comprise an uninterrupted octagonal pattern which may be superimposed over the first two layers. It is understood that other polygonal patterns may also be used. The pattern layer 30 may also comprise other regular patterns, irregular patterns, or tessellations that do not include polygons.

Figure 7:
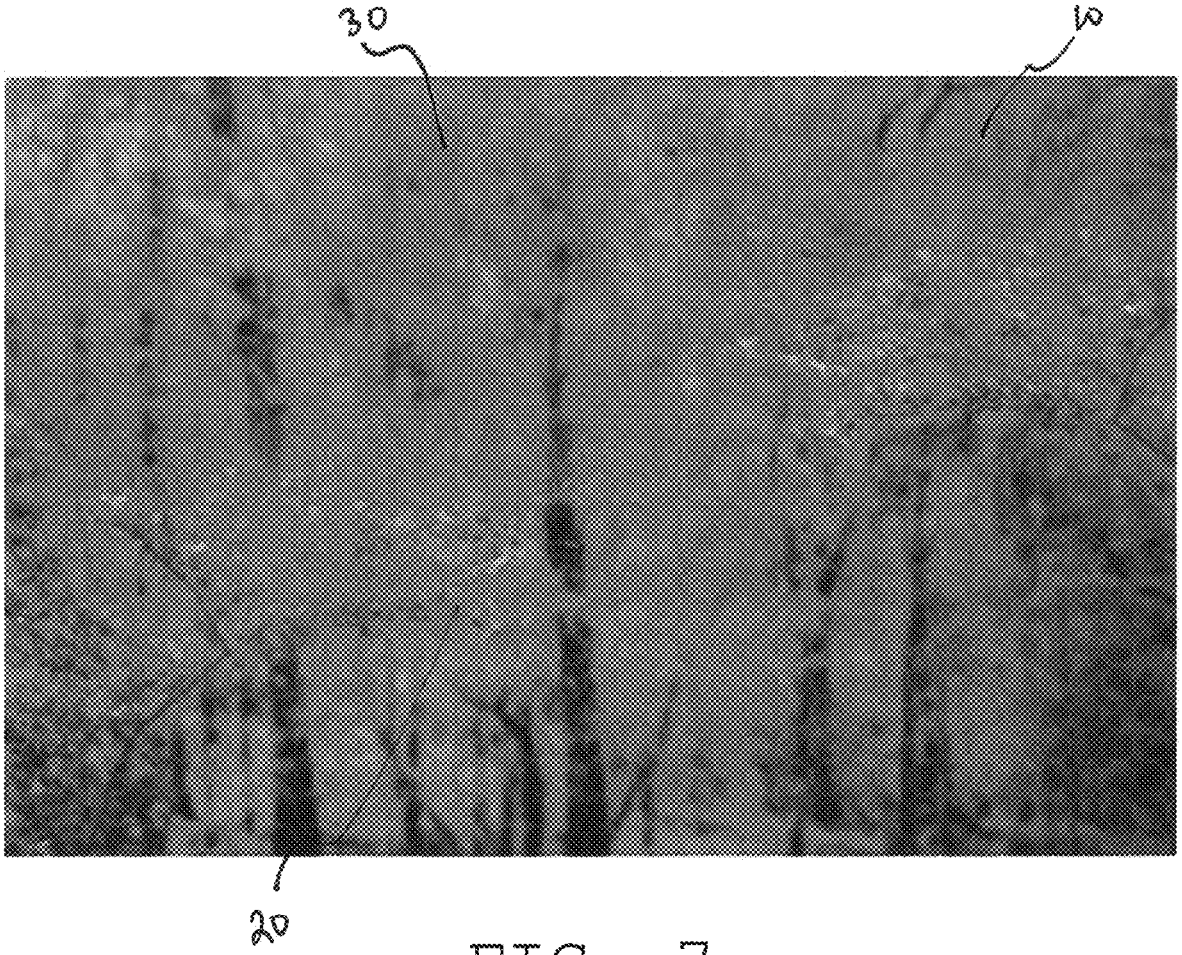
FIG. 7 is an image of multiple layers of a camouflage system according to an embodiment of the disclosure.

FIG. 7 shows a composite image of layers 10, 20, 30 according to an embodiment of the present disclosure.

Figure 6:
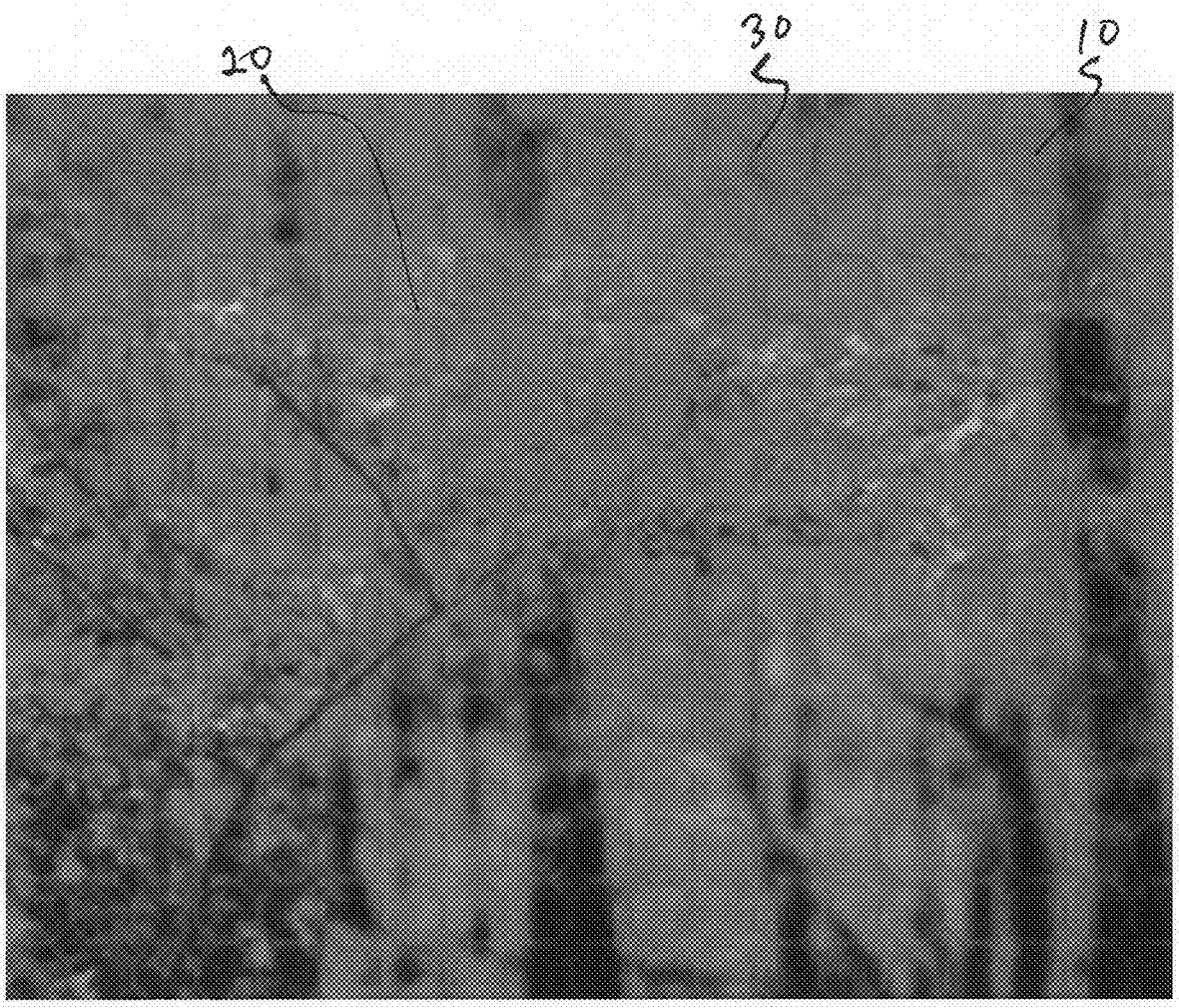
FIG. 6 is a close-up of a portion of the image of FIG. 7.

FIG. 6 shows a close-up of a portion of the composite image of FIG. 7.

Figure 8:
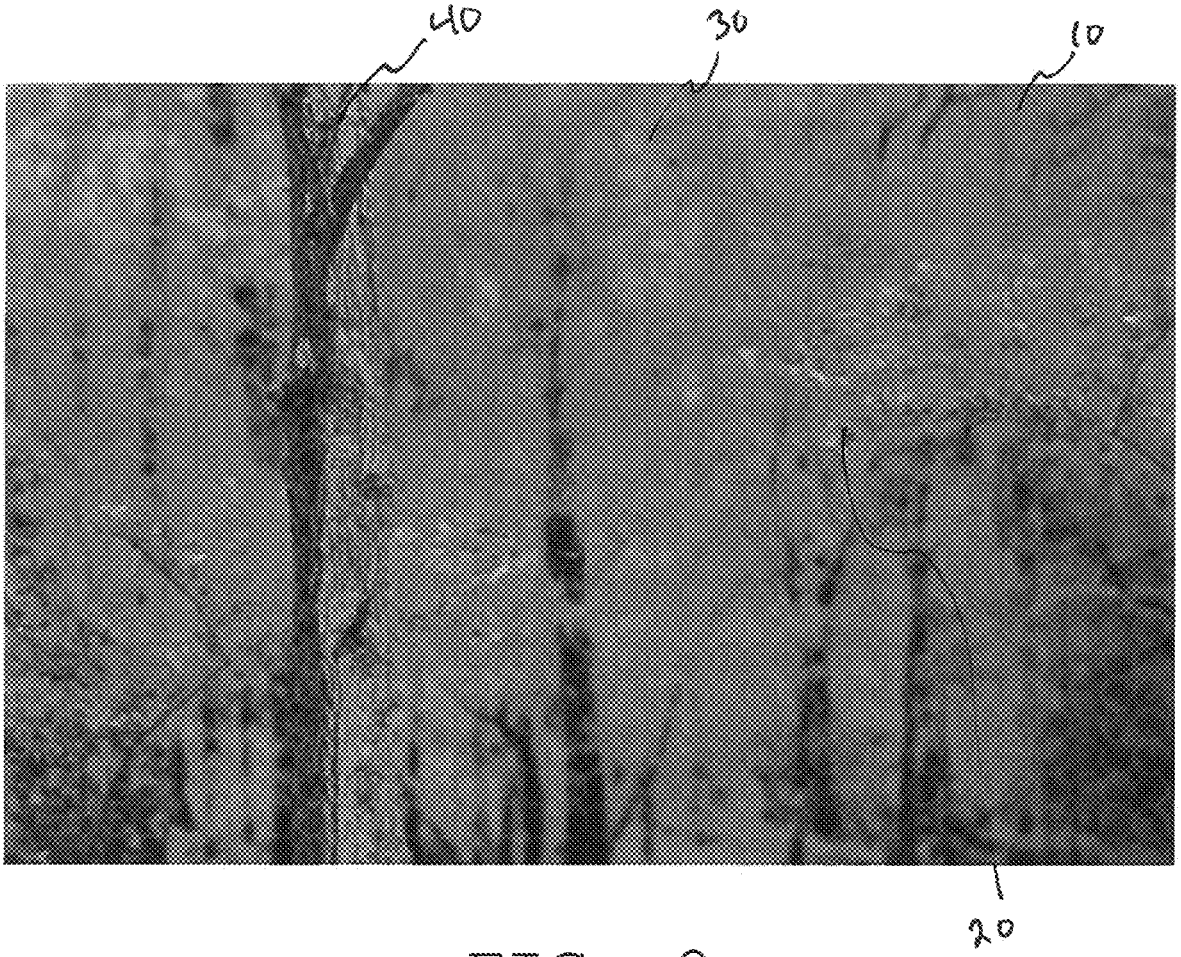
FIG. 8 is an image of multiple layers of a camouflage system according to an embodiment of the disclosure.

FIG. 8 shows a composite image of layers 10, 20, 30, 40 according to an embodiment of the present disclosure.

Figure 9:
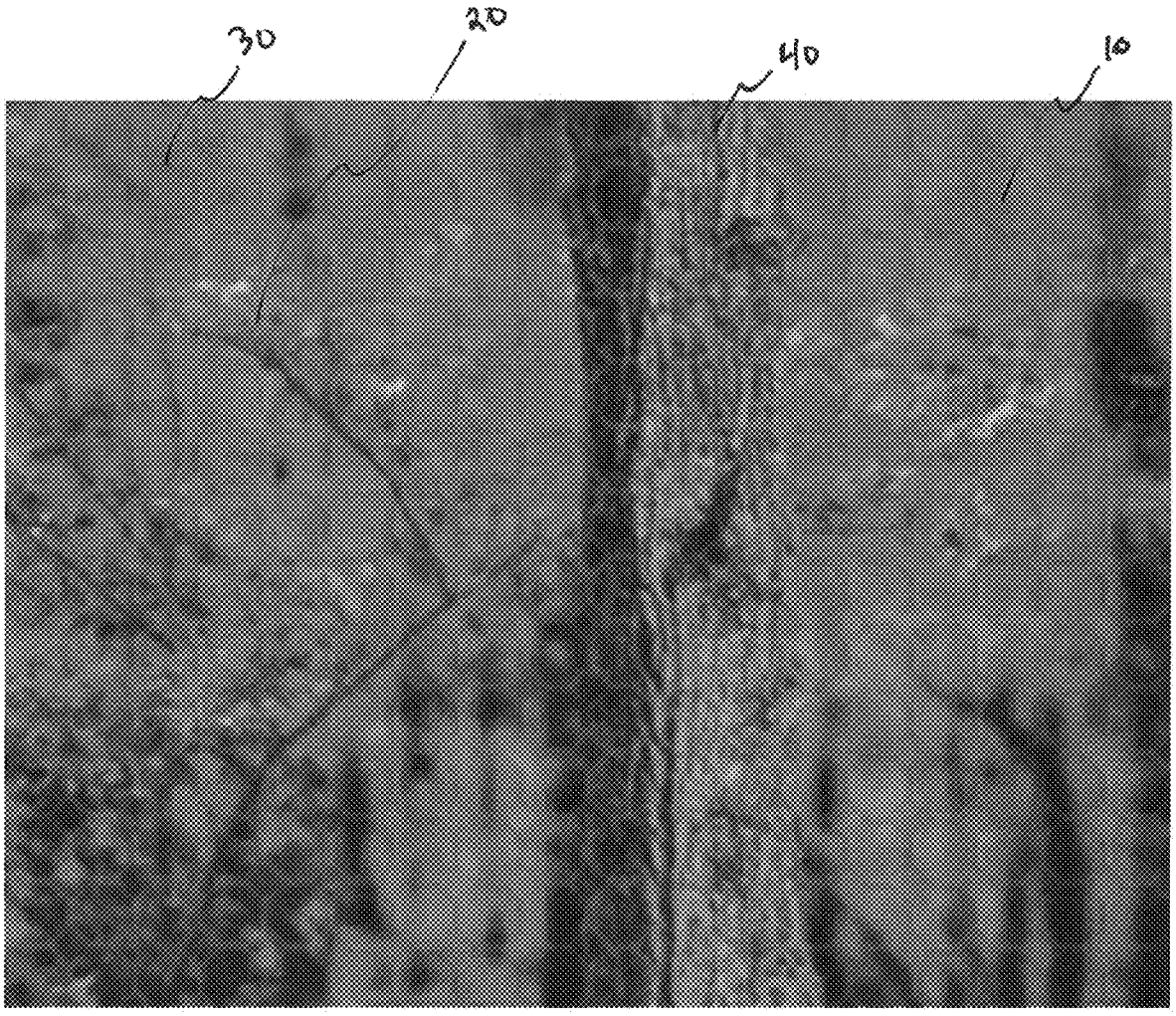
FIG. 9 is a close-up of a portion of the image of FIG. 8.

FIG. 9 shows a close-up of a portion of the composite image of FIG. 8.

Figure 10:
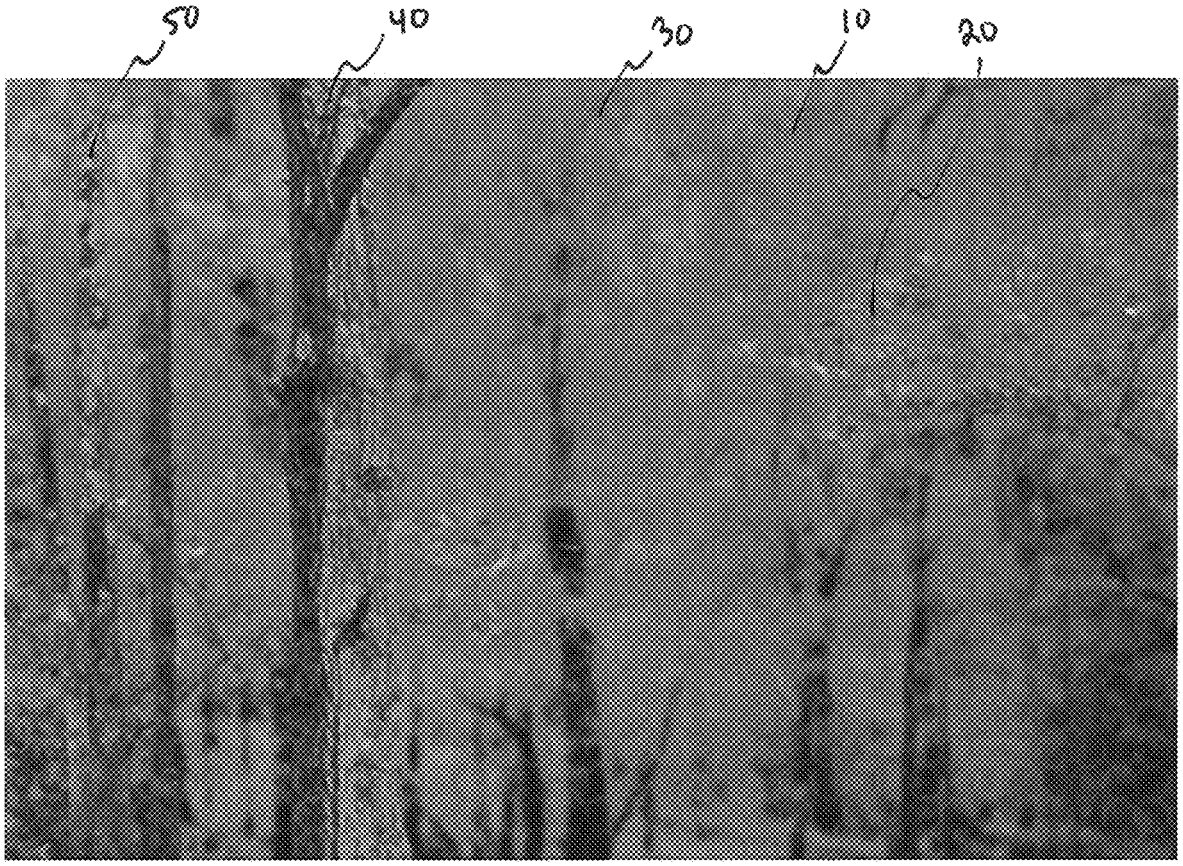
FIG. 10 is an image of multiple layers of a camouflage system according to an embodiment of the disclosure.

FIG. 10 shows a composite image of layers 10, 20, 30, 40, 50 according to an embodiment of the present disclosure.

Figure 11:
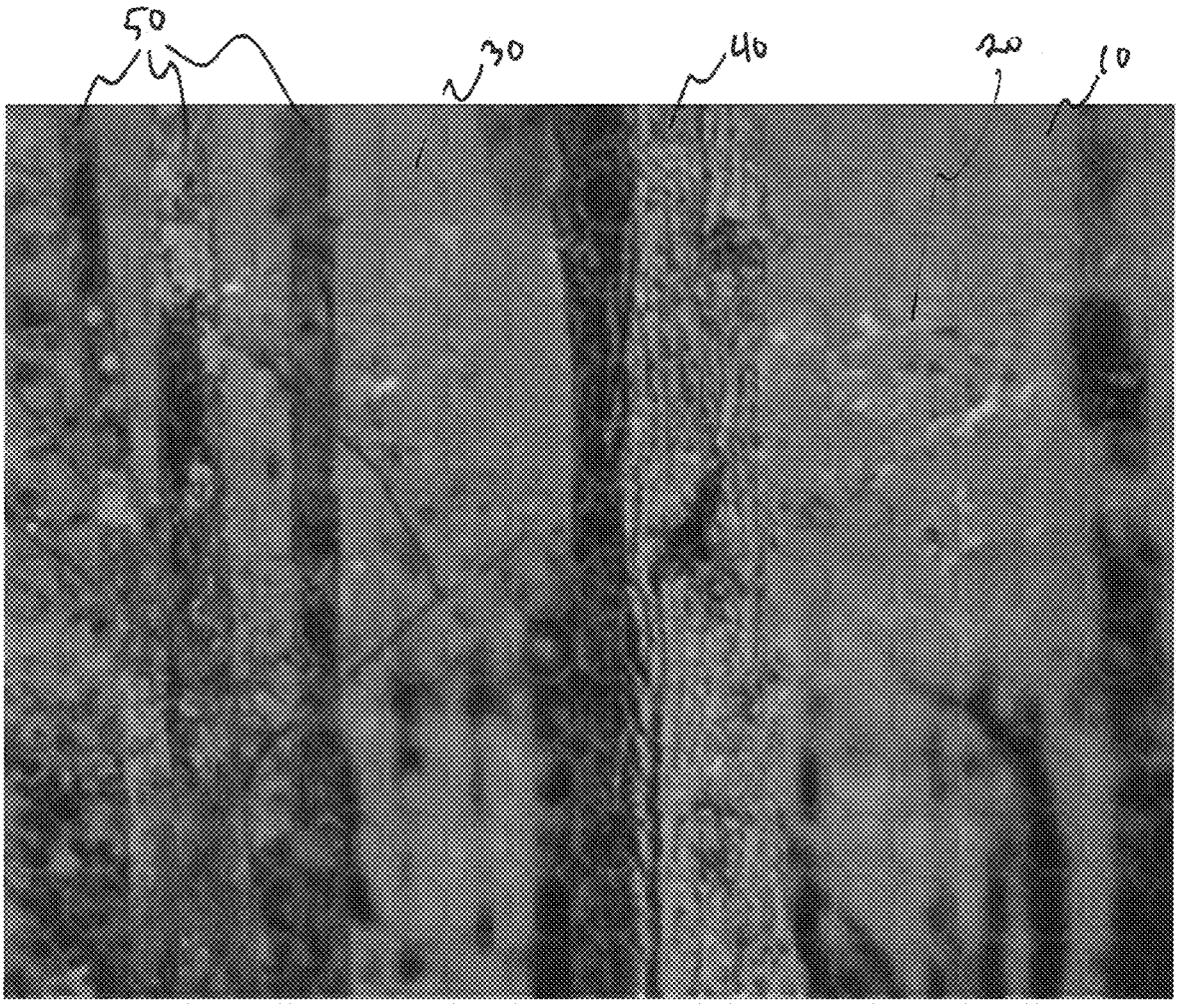
FIG. 11 is a close-up of a portion of the image of FIG. 10.

FIG. 11 shows a close-up of a portion of the composite image of FIG. 10.

Figure 12:
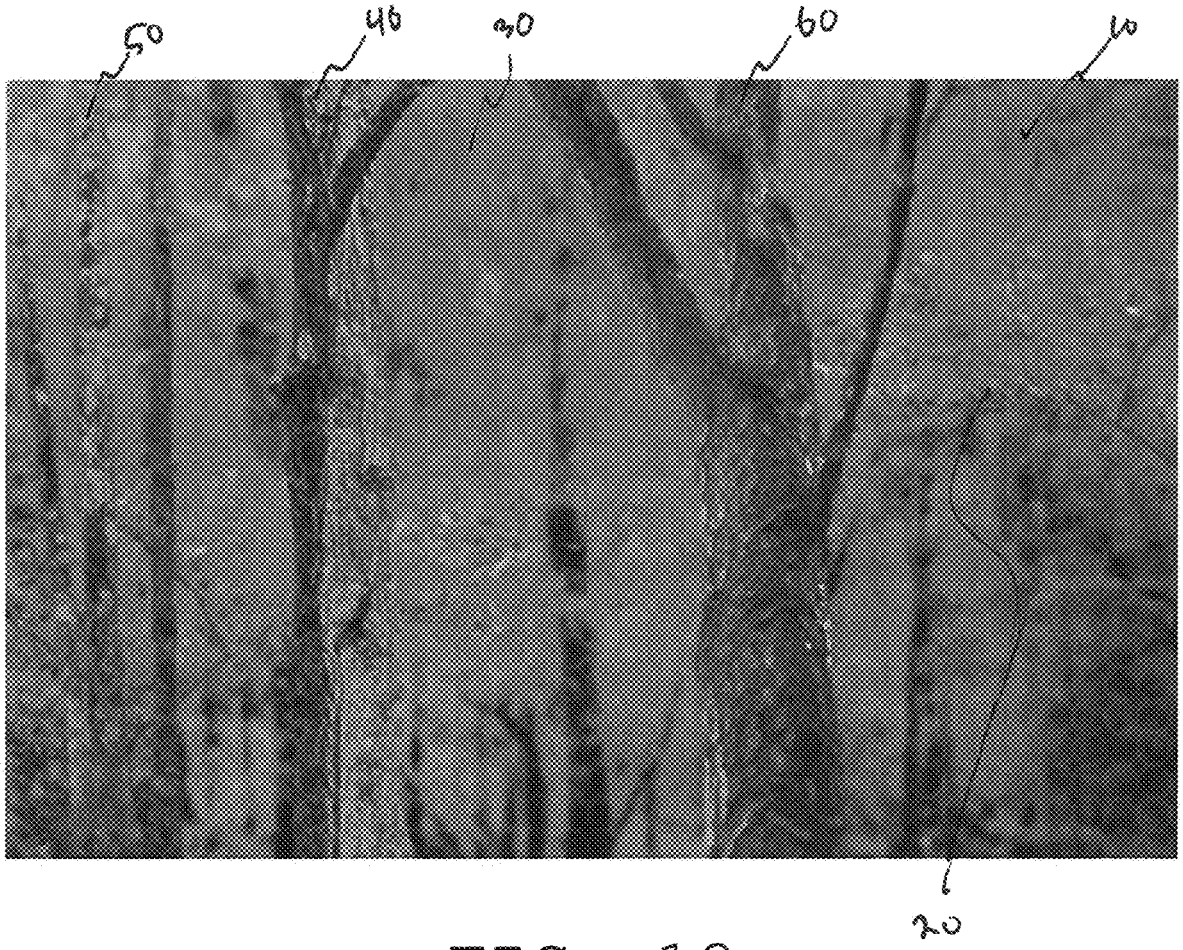
FIG. 12 is an image of multiple layers of a camouflage system according to an embodiment of the disclosure.

FIG. 12 shows a composite image of layers 10, 20, 30, 40, 50, 60 according to an embodiment of the present disclosure.

Figure 13:
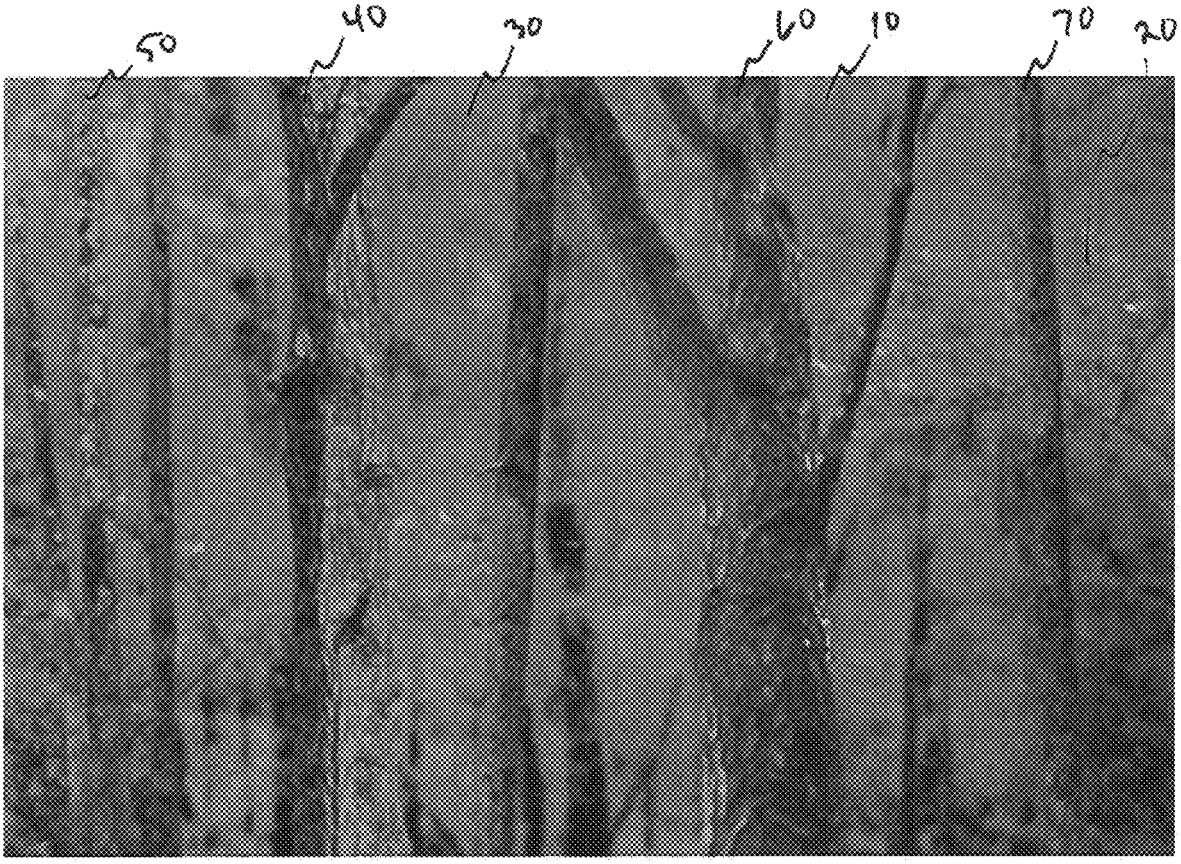
FIG. 13 is an image of multiple layers of a camouflage system according to an embodiment of the disclosure.

FIG. 13 shows a composite image of layers 10, 20, 30, 40, 50, 60, 70 according to an embodiment of the present disclosure.

The fourth layer 40, fifth layer 50, sixth layer 60, and seventh layer 70 establish a focal point of the camouflage. These layers 40, 50, 60, 70 comprise high definition images of real-world environment. These images 40, 50, 60, 70 may all be in focus or in various degrees of focus. The images in these layers comprise foliage and/or other natural objects (e.g., rocks, water, etc.), with the images being interleaved between the third layer, further adding the depth of field. For example, the fourth layer 40 (e.g., medium size trees) may appear behind the patterned layer 30, while the fifth layer 50, sixth layer 60, and seventh layer 70 appear in front of the patterned layer 30. This further enhances the depth of field.

The set of layers arranged behind the pattern layer may be referred to collectively as the base layers, and the set of layers in front of the pattern layer may be referred to collectively as the detail layers. For example, in one embodiment the base layer set may comprise the first layer 10, the second layer 20, and the fourth layer 40, and the detail layer set may comprise the fifth layer 50, the sixth layer 60, and the seventh layer 70. However, it is understood that the layers may be switched around such that the base layer set and the detail layer set comprise different combinations of constituent layers to achieve a desired effect.

To provide the appearance of natural lighting, countershading may be applied to images within the layers. Top side portions of the images appear brighter, contrasted with bottom side portions of the images appearing darker.

Figure 14:
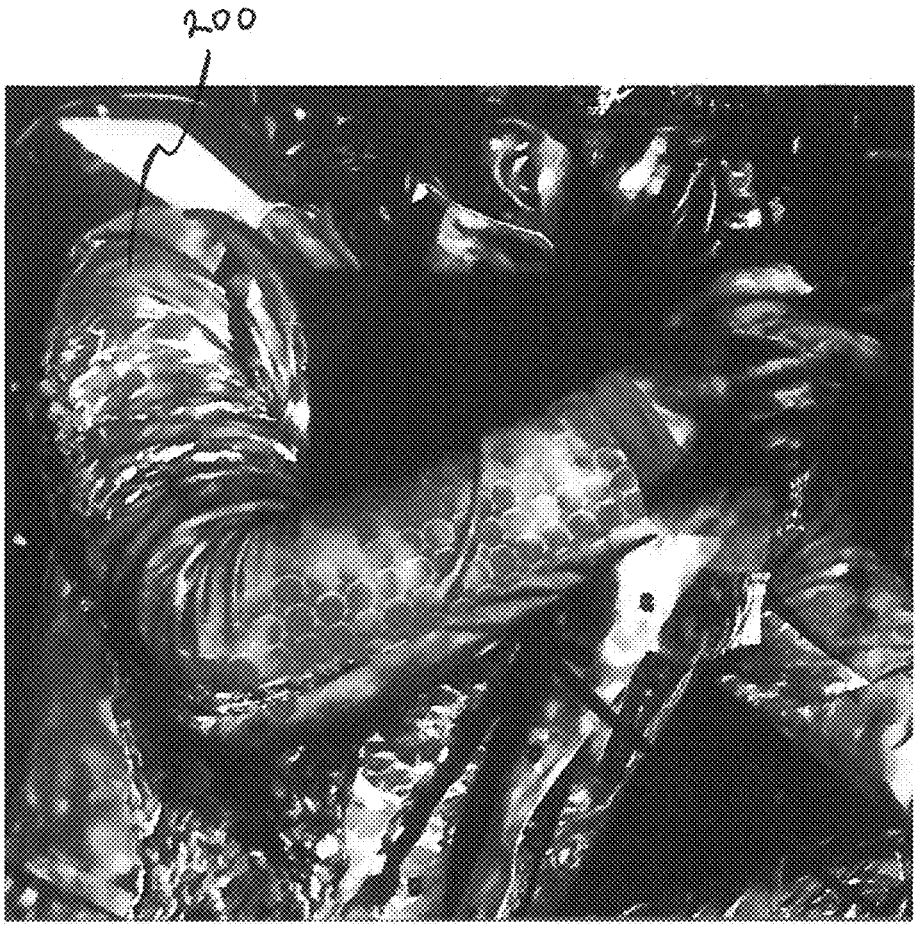
FIG. 14 is perspective view of a hunter wearing a garment that incorporates a camouflage system according to the present disclosure.

FIG. 14 shows a hunter wearing a garment 200 that incorporates an embodiment of the camo system disclosed herein.

Although the exemplary embodiment of the camo system shown herein is designed to be used in a deciduous forest environment, other embodiments may be adapted for use in various other kinds of environments, for example: prairie, wetland, mountain, savanna, grassland, coniferous forest, desert, swampland, and many others.

In one embodiment of the camo system, the entire system is reversible to allow for use in multiple environments and/or times of day.

Embodiments of the camo system may be applied to many different kinds of objects such as vehicles, dwelling structures, storage units, weapons, and pipelines, for example. The system is also applicable on articles of clothing such as hats, shoes, jackets, pants, overalls, and gloves, for example.

Embodiments of the present system may be customized for a particular application that is tailored to a user's exact specifications. Some of the layers within the system may comprise images provided by a user; thus, the system is easily customized and personalized.

Some embodiments of the present invention may include a combination of base images from a macro-environment and detailed images from a micro-environment to provide a camo system that is tailored for use in a very specific environment. For example, in one embodiment, a set of base layers may mimic a general desert environment (i.e., the macro-environment) with a set of detailed images that are designed to further customize the camo system to a more specific variety of desert environment (i.e., the micro-environment). In such an embodiment, the base layers (e.g., the first and second layers) may mimic the desert environment generally and the detailed layers (e.g., the fourth, fifth, sixth, and seventh layers) may provide specific imagery from the southwestern United States, for example. In another embodiment, the base layers recreate a general desert environment, with the detailed layers providing imagery that mimic the Sahara from North Africa.

Using this system, garments, gear, and other products bearing the camo system can be manufactured with a particular base macro-environment and sold to manufacturers and/or distributors that are capable of applying the detailed imagery for a more specific customization. As previously noted, customization can be as specific as necessary, for example, to mimic scenery on a particular farm, ranch, or lease.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

We claim:

1. A camouflage system, comprising:

a base layer set, said base layer set comprising:

at least one unfocused background image layer; and at least one semi-focused image layer;

a geometric pattern layer over said base layer set, said geometric pattern layer comprising a continuous pattern of polygonal shapes; and a detail layer set over said geometric pattern layer, said detail layer set comprising a high-definition image layer, wherein said base layer set, said geometric pattern layer, and said detail layer set each comprise images comprising orange colors and colors from grey to black, such that said camouflage system is substantially invisible to dichromats and substantially visible to trichromats.

2. The camouflage system of claim 1, said at least one base layer set further comprising:

more than one unfocused background image layers; and more than one semi-focused image layers.

3. The camouflage system of claim 2, said base layer set further comprising at least one high-definition image layer.

4. The camouflage system of claim 1, said detail layer set comprising a plurality of high-definition image layers, each of said high-definition image layers comprising imagery of different natural objects.

5. The camouflage system of claim 1, wherein said detail layer set comprises at least three high-definition image layers, each of said high-definition image layers comprising imagery of different natural objects.

6. The camouflage system of claim 1, said base layer set comprising imagery from a macro-environment and said detail layer set comprising imagery from a micro-environment.

7. The camouflage system of claim 1, wherein said base layer set and said detail layer set comprise images of foliage.

8. A garment, comprising:

a base material comprising a camouflage system, said camouflage system comprising:

a base layer set, said base layer set comprising:

at least one unfocused background image layer; and at least one semi-focused image layer;

a geometric pattern layer over said base layer set, said geometric pattern layer comprising a continuous pattern of polygonal shapes; and a detail layer set over said geometric pattern layer, said detail layer set comprising a high-definition image layer, wherein said base layer set, said geometric pattern layer, and said detail layer set each comprise images comprising orange colors and colors from grey to black, such that said camouflage system is substantially invisible to dichromats and substantially visible to trichromats.

9. The garment of claim 8, said at least one base layer set, comprising:

more than one unfocused background image layers; and more than one semi-focused image layers.

10. The garment of claim 8, wherein said detail layer set comprises at least three high-definition image layers, each of said high-definition image layers comprising imagery of different natural objects.

11. A method of camouflaging an object, comprising:

providing a base layer set, comprising:

at least one unfocused background image layer; and at least one semi-focused image layer;

providing a geometric pattern layer over said base layer set, said geometric pattern layer comprising a continuous pattern of polygonal shapes; and providing a detail layer set over said geometric pattern layer, said detail layer set comprising a high-definition image layer, wherein said base layer set, said geometric pattern layer, and said detail layer set each comprise images comprising orange colors and colors from grey to black, such that said camouflage system is substantially invisible to dichromats and substantially visible to trichromats.

12. The camouflage system of claim 1, wherein said orange colors comprise Pantone 152.

13. The garment of claim 8, wherein said orange colors comprise Pantone 152.

14. The camouflage system of claim 1, wherein said continuous pattern of regular polygonal shapes is arranged in a tessellation.

15. The garment of claim 8, wherein said continuous pattern of regular polygonal shapes is arranged in a tessellation.

* * * * *